US006702517B2

(12) United States Patent
Goddard

(10) Patent No.: US 6,702,517 B2
(45) Date of Patent: Mar. 9, 2004

(54) PIPE ASSEMBLY FOR COLLECTING SURFACE WATER RUNOFF AND ASSOCIATED METHODS

(75) Inventor: James B. Goddard, Powell, OH (US)

(73) Assignee: Advanced Drainage Systems, Inc., Columbus, OH (US)

( * ) Notice: Subject to any disclaimer, the term of this patent is extended or adjusted under 35 U.S.C. 154(b) by 0 days.

(21) Appl. No.: 09/989,173

(22) Filed: Nov. 21, 2001

(65) Prior Publication Data

US 2003/0031512 A1 Feb. 13, 2003

Related U.S. Application Data

(60) Provisional application No. 60/311,099, filed on Aug. 10, 2001.

(51) Int. Cl.[7] ..... E02B 11/00

(52) U.S. Cl. ..... 405/45; 405/49; 405/43; 138/111; 138/105

(58) Field of Search ..... 405/36, 37, 38, 405/39, 43, 44, 45, 49, 51, 157, 189.5, 178; 138/111, 112, 113, 105

(56) References Cited

U.S. PATENT DOCUMENTS

| | | | | | |
|---|---|---|---|---|---|
| 245,285 | A | * | 8/1881 | Detrick | 138/113 |
| 697,845 | A | * | 4/1902 | Hultman | 138/111 |
| 3,060,693 | A | | 10/1962 | Taylor | |
| 3,313,321 | A | * | 4/1967 | Keller | 138/112 |
| 3,933,181 | A | * | 1/1976 | Nilsson et al. | 138/111 |
| 4,199,009 | A | * | 4/1980 | Ballone | 138/112 |
| 4,246,305 | A | | 1/1981 | Delattre | |
| 4,261,823 | A | | 4/1981 | Gallagher et al. | |
| 4,451,172 | A | | 5/1984 | Lamphier et al. | |
| 4,741,593 | A | * | 5/1988 | Fochler | 138/111 |
| 4,824,288 | A | | 4/1989 | Naito | |
| 4,995,759 | A | | 2/1991 | Plowman et al. | |
| 5,051,028 | A | | 9/1991 | Houck et al. | |
| 5,516,229 | A | | 5/1996 | Atchley et al. | |
| 5,520,481 | A | | 5/1996 | Atchley et al. | |
| 5,810,510 | A | | 9/1998 | Urriola | |
| 5,836,716 | A | * | 11/1998 | Johnson et al. | 405/43 |
| 5,890,838 | A | | 4/1999 | Moore, Jr. et al. | |
| 5,915,880 | A | | 6/1999 | Nordberg | |
| 5,934,828 | A | | 8/1999 | Hu et al. | |
| 6,126,209 | A | | 10/2000 | Goddard | |

FOREIGN PATENT DOCUMENTS

GB 2040151 A 8/1980

OTHER PUBLICATIONS

International Search Report, Nov. 20, 2002, corresponding to PCT/US 02/24990.

D. E. Beck, P .E., "Alternatives in stormwater management", pp. 62–68, Progressive Engineering, CE News/Sep. '99.

(List continued on next page.)

*Primary Examiner*—Frederick L. Lagman
(74) *Attorney, Agent, or Firm*—Finnegan, Henderson, Farabow, Garrett & Dunner, LLP

(57) ABSTRACT

The present invention includes a pipe assembly for collecting water runoff. The pipe assembly includes a plurality of elongated primary pipes disposed in adjacent contact along their lengths. Each pair of adjacent elongated primary pipes define upper and lower elongated voids between adjacent pipe haunches and upper and lower imaginary planes tangential thereto. An elongated secondary pipe is disposed in each void in tangential contact along its length with the two adjacent elongated primary pipes defining the void. A material transversely encompasses the plurality of elongated primary pipes and elongated secondary pipes. The pipe assembly may be used in a water storage system and methods for installing such a system. The pipe assembly may also be used in a method for collecting surface water. The pipe assembly may be used in a system for use in a water flow path.

48 Claims, 9 Drawing Sheets

OTHER PUBLICATIONS

Sewer Manual for Corrugated Steel Pipe, "Storm Water Management", National Corrugated Steel Pipe Association, Chapter 9 (undated).
Brochure, "Patented Multi–Pipe Units for On–Site Septic Systems," ADS (undated).
"Storm Water Detention/Retention System Design", Tech Note 2. 120, Apr. 24, 1997 (revised Jan. 2000).
Brochure "Best Management Practices for EPA Phase II", ADS, 2001.
James B. Goddard, "Stability of Profile or Corrugated Wall Flexible Pipe", (undate).
Brochure "N–12 & N–12 HC Pipe Large Diameter HDPE Pipe for Agriculture," ADS (undated).
Storm Water Retention Design Manual consisting of: Table of Contents Introduction J.B. Goddard, "Storm Water Retention and Disposal", Tech Note 2. 120, Aug. 27, 1982.
James B. Goddard, "Storm Water Detention/Retention: A New Solution", Article.
Florida Design Procedure Introduction (Chapter 1) Principles of Stormwater Management (Chapter 4) Calculations to Estimate Runoff (Chapter 5) Infiltration Trenches (6–70 to 6–84) (6–176 to 6–219) Standards and Specifications for Individual Management Practices (Part III) (6–220 to 6–372).
ADS Product Information.
Brochure, "ADS Corrugated Polyethylene Pipe for strong, maintenance–free culverts".
Brochure, "Control highway construction and maintenance costs with tough, durable ADS pipe".
James B. Goddard, "Slot Dimensions", Tech Note 2. 111, Feb. 1985.
R. C. Reeve, Outflow from ADS Corrugated Plastic Tubing (Exfiltration), Tech Note 2. 105, Mar. 11, 1980.
Ronald C. Reeve, "Laboratory Determination of Soil Permeability", Tech Note 2. 113, Jul. 12, 1982.
Ronald C. Reeve, "Soil Permeability—Auger Hole Method", Tech Note 2. 118, Jul. 12, 1982.
R.C. Reeve, "Flow Capacity—Subsurface Drains", Tech Note 2. 109, Oct. 21, 1983.
Brochure, "A double–barreled solution to tough siltation problems from".
J.B. Goddard, "Sock Drain Envelope Material, Technical Data Sheet", Tech Note 2. 103, Nov. 1, 1984.
R.C. Reeve, "DrainGuard Technical Data Sheet", Tech Note 2. 107, Nov. 1, 1984.
Dr. A.P . Moser, "The Structural Performance of Buried 48 inch Diameter N–12® HC Polyethylene Pipes," Technical Report 4.104, Sep. 30, 1994.
Brochure "ProLink Ultra Pipe," ADS (undated).
Debra K. Rubin, et al., "Regulating Runoff," cover, p.3., and pp. 40–42, The Construction Weekly, Oct. 15, 2001.
Tom Rueschhoff, "Superior International Watershed, A View from Salmon Trout Bay," ADS, Pipeline Brochure, vol. 10, No. 4, Fourth Quarter 2001.
MaryBeth Weber, "The Watershed Management Plan State–of–the–Art Monitoring Daylighting Buried Streams", ADS, Stormwater Brochure, Nov./Dec. 2001.
Barry Gantenbein, "Water Detention System Goes Underground in Milwaukee", ADS, Western Builder Brochure, 91$^{st}$Year No. 14, Apr. 5, 2001.

* cited by examiner

PIPE ASSEMBLY FOR COLLECTING SURFACE WATER RUNOFF AND ASSOCIATED METHODS

This application claims the benefit of Provisional Application No. 60/311,099, filed Aug. 10, 2001.

DESCRIPTION OF THE INVENTION

1. Field of the Invention

The present invention relates to water storage systems and associated methods in general. More particularly, the present invention relates to a pipe assembly for collecting surface water runoff and associated methods. The pipe assembly includes both primary and secondary pipes.

2. Background of the Invention

Storm water retention/detention systems are useful wherever there is a need to prevent water from collecting on a surface. Some traditional locations for these systems are near buildings or parking lots, the construction of which have altered the ability of the ground to absorb the water. Some states even require that these systems be provided to, at a minimum, maintain the original amount of water absorption in that area. As a result, these storm water retention/detention systems have become a staple feature of construction sites.

Traditionally, the storm water retention/detention system included a plurality of substantially parallel pipes disposed in the ground. Such systems were placed in a bed dug in the earth and a fill material was placed around the pipes. The traditional approach required a minimum spacing between the pipes, which served several purposes. One such purpose was to provide a load path for the pipes to transmit loading to the surrounding material. However, in providing a minimum spacing ensure stability of the storm water retention/detention system, the footprint of the system was large.

As a result of the minimum spacing, the area needed for the known storm water retention/detention system was often greater than the area available on the property. Therefore, small businesses could not afford a traditional system because they would need to purchase additional property just to install the system.

The present inventor has proposed a new pipe assembly that can assist in decreasing the footprint size of a storm water retention/detention system among other advantages.

SUMMARY OF THE INVENTION

Accordingly, the present invention is directed to a pipe assembly for collecting surface water, a water storage system, and associated methods for collecting surface water and installing the water storage system that substantially obviates one or more problems associated with the traditional storm water retention/detention system.

To achieve these and other advantages and in accordance with the purpose of the invention, as embodied and broadly described herein, the present invention includes a pipe assembly for collecting water runoff. The pipe assembly includes a plurality of elongated primary pipes disposed in adjacent contact along their lengths. Each pair of adjacent elongated primary pipes define upper and lower elongated voids between adjacent pipe haunches and upper and lower imaginary planes tangential thereto. An elongated secondary pipe is disposed in each void in tangential contact along its length with the two adjacent elongated primary pipes defining the void. A material transversely encompasses the plurality of elongated primary pipes and elongated secondary pipes.

In a preferred embodiment of the pipe assembly, the primary and secondary pipes are formed of a flexible material such as corrugated plastic, smooth wall plastic, or corrugated metal.

In another preferred embodiment, the walls of the primary and secondary pipes are perforated.

Preferably, the material transversely encompassing the plurality of elongated primary and secondary pipes comprises two layers, one of the two layers having sufficient strength to hold the plurality of elongated primary and secondary pipes in tangential contact, and the other of the two layers being porous to fluid but preventing passage of particulates.

The present invention is also directed to a water storage system for collecting surface water. The water storage system includes a pipe assembly arranged on the bottom of a hole in the earth, and a fill material substantially covering the pipe assembly and substantially filling the hole in the earth. The pipe assembly includes a plurality of elongated primary pipes disposed in tangential contact along their lengths. Each pair of primary pipes defines upper and lower voids between adjacent pipe haunches and upper and lower imaginary planes tangential to the adjacent primary pipes. An elongated secondary pipe is disposed in each void in tangential contact along its length with both adjacent primary pipes. A material encompasses the plurality of elongated primary pipes and elongated secondary pipes.

The present invention is also directed to a method of installing a water storage system. The method includes digging a hole in the earth, such that the hole has a substantially planar bottom surface. Placing a material on the planar surface, wherein the material has opposed ends. Arranging a first plurality of elongated secondary pipes on the material, wherein the elongated secondary pipes are spaced from and substantially parallel to each other. Disposing a plurality of elongated primary pipes on the material in elongated tangential contact, wherein each pair of adjacent primary pipes defines upper and lower voids between adjacent pipe haunches and upper and lower imaginary planes tangential to the adjacent primary pipes. The primary pipes are disposed to locate one of the first plurality of elongated secondary pipes in each lower void in tangential contact with both adjacent elongated primary pipes along their lengths. Next, arranging an elongated secondary pipe in each of the upper voids in elongated tangential contact with the primary pipes defining the void. Finally, connecting the opposed ends of the material to encompass the plurality of elongated primary and secondary pipes with the material to form a pipe assembly.

The present invention is also directed to a method of collecting surface water from a surface. The method includes providing a pipe assembly arranged on the bottom of a hole in the earth. Disposing the pipe assembly between an input flow path and an output flow path. Draining at least a portion of the surface water using the input flow path. Collecting the portion of the surface water in the pipe assembly. Draining at least some of the portion of the surface water collected in the pipe assembly through the output flow path The pipe assembly including a plurality of elongated primary pipes disposed in tangential contact along their lengths. Each pair of primary pipes define upper and lower voids between adjacent pipe haunches and upper and lower imaginary planes tangential to the adjacent primary pipes. An elongated secondary pipe is disposed in each void in tangential contact along its length with both adjacent primary pipes. A material encompassing the plurality of elongated primary pipes and elongated secondary pipes.

The present invention is also directed to a system for use in a water flow path. The system includes a pipe assembly arranged in a water flow path and a path formed over the pipe assembly. The pipe assembly includes a plurality of elongated primary pipes disposed in adjacent contact along their lengths. Each pair of adjacent elongated primary pipes define upper and lower elongated voids between adjacent pipe haunches and upper and lower imaginary planes tangential thereto. An elongated secondary pipe is disposed in each void in tangential contact along its length with the two adjacent elongated primary pipes defining the void. A material transversely encompasses the plurality of elongated primary pipes and elongated secondary pipes.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DESCRIPTION OF THE EMBODIMENTS

Figure 1:
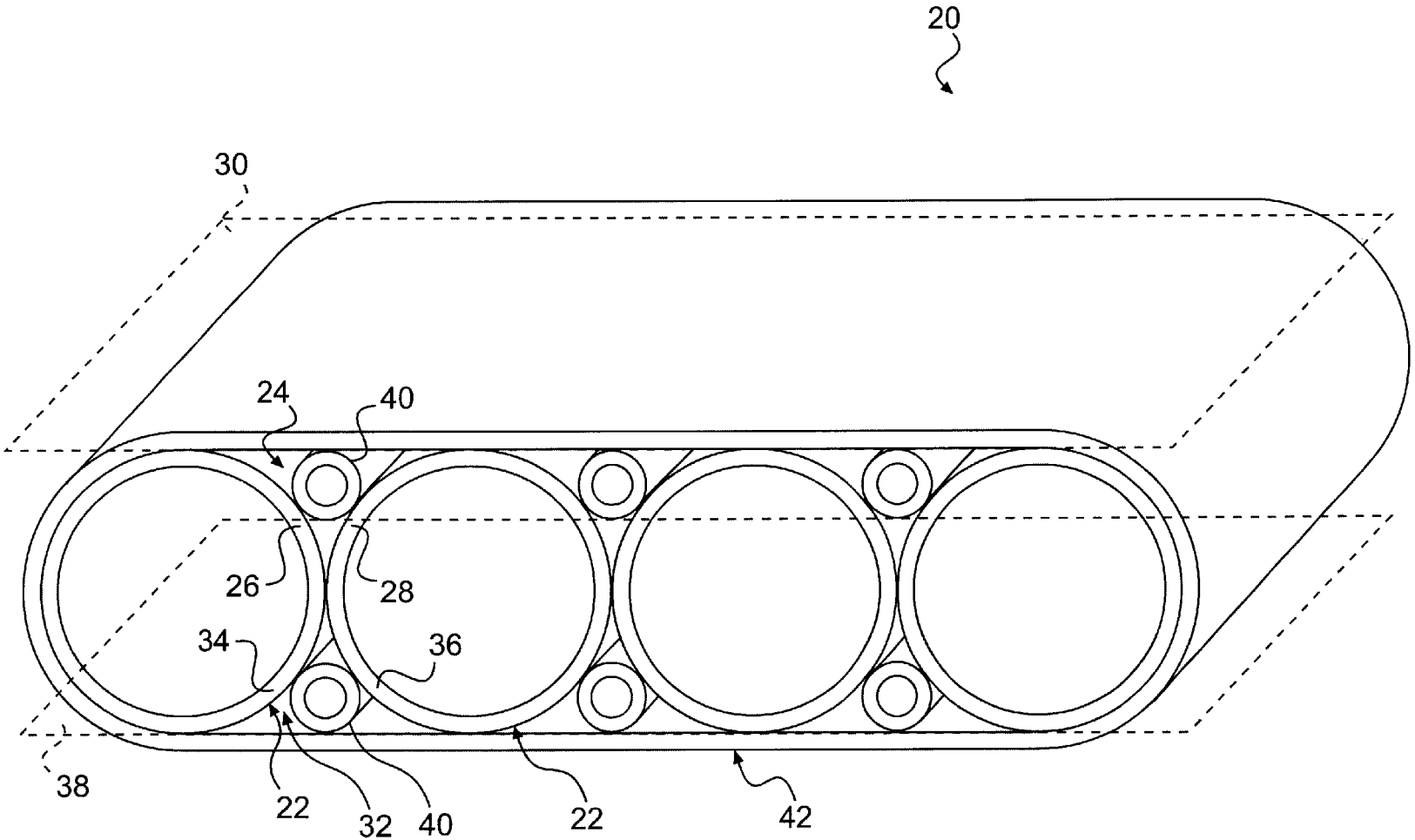
FIG. 1 is an isometric right side view of the pipe assembly of the present invention.

Reference will now be made in detail to the present embodiments of the invention, examples of which are illustrated in the accompanying drawings. Wherever possible, the same reference numbers will be used throughout the drawings to refer to the same or like parts.

In accordance with the present invention, the pipe assembly for collecting water runoff comprises a plurality of elongated primary pipes disposed in adjacent contact along their lengths. Each pair of adjacent elongated primary pipes define upper and lower elongated voids between adjacent pipe haunches and upper and lower imaginary planes tangential thereto. As embodied herein and depicted in FIG. 1, the pipe assembly 20 for collecting water runoff includes a plurality of elongated primary pipes 22 disposed in adjacent contact along their lengths. Each pair of adjacent elongated primary pipes 22 define upper elongated voids 24 between adjacent pipe haunches 26, 28 and an upper imaginary plane 30 tangential to the adjacent primary pipes 22. Each pair of adjacent elongated primary pipes 22 also define lower elongated voids 32 between adjacent pipe haunches 34, 36 and a lower imaginary plane 38 tangential to the adjacent primary pipes 22.

The pipe assembly of the present invention further comprises an elongated secondary pipe disposed in each void in tangential contact along its length with the two adjacent elongated primary pipes defining the void. In the embodiment depicted in FIG. 1, elongated secondary pipe 40 is disposed in each of the upper and lower elongated voids 24, 32 in tangential contact along its length with the two adjacent elongated primary pipes 22 defining the voids 24, 32.

The pipe assembly 20, shown in FIG. 1, includes four elongated primary pipes and six elongated secondary pipes. It is understood that the number of primary pipes and the number of secondary pipes may be increased or decreased depending on two factors: the desired size of the system and the amount of water runoff to be collected. The relationship of the size of the pipes can be optimized by solving the following equations:

$$x^2+r_2^2=(r_1+r_2)^2; \quad (1)$$

and $$x+r_1=r_2. \quad (2)$$

Figure 11:
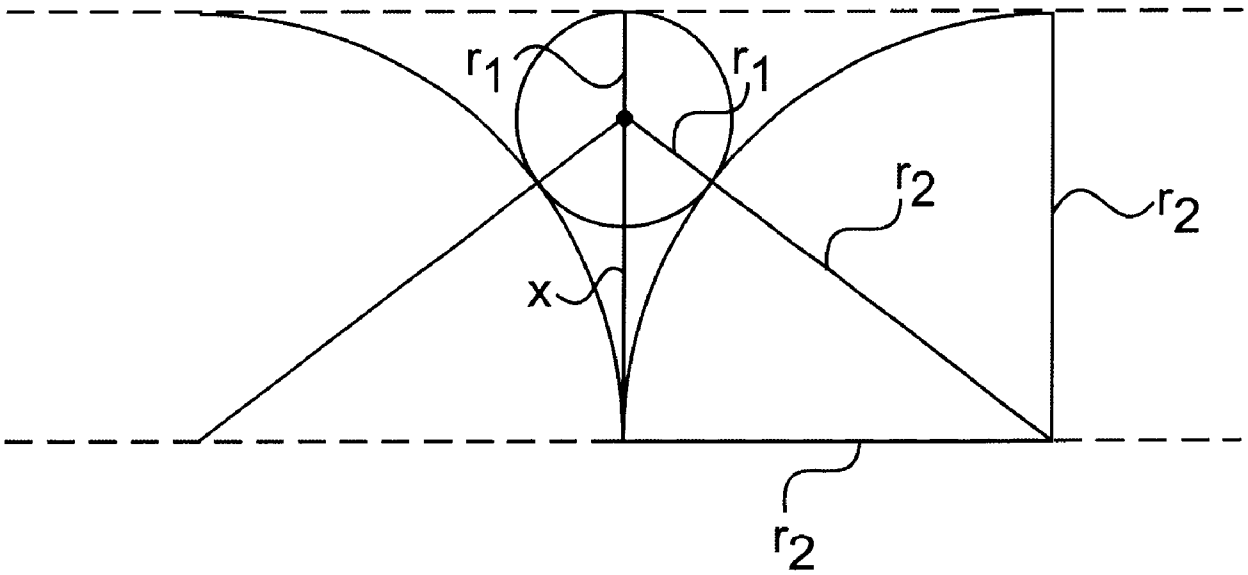
FIG. 11 is a schematic used to determine an optimal size for a secondary pipe.

In the proceeding equations $r_1$ is the radius of the secondary pipe, $r_2$ is the radius of the primary pipe, and x is equal to the vertical height between the center of the primary pipe and the center of the secondary pipe, as shown in FIG. 11. Solving for $r_1$, the preferred radius of the secondary pipe is equal to ¼ the radius of the primary pipe. It is understood that existing pipes may not provide the exact relationship described above. Therefore, a ratio of approximately 1:4 is preferred, but not required.

For example, in one embodiment, the primary pipes 22 may be 42 inch N-12 Ultra pipes available from Advanced Drainage Systems, Inc. Using the above relationship, the secondary pipes 40 may be 10 inch N-12 pipes available from Advanced Drainage Systems, Inc.

The pipe assembly 20 provides a spring-like effect when it is installed in the ground. This spring-like effect helps the pipe assembly to carry loads similar to traditional storm water retention/detention systems without the required spacing of the pipes.

Also in accordance with the invention, the pipe assembly comprises a material transversely encompasses the plurality of elongated primary pipes and elongated secondary pipes. As embodied herein and depicted in FIG. 1 the material 42 transversely encompasses the plurality of elongated primary pipes 22 and elongated secondary pipes 40.

The material 42, as seen in FIG. 1, has sufficient strength to hold the plurality of elongated primary and secondary pipes 22, 40 in tangential contact and is porous to fluid but prevents passage of particulates. The material 42 may substantially encompass the length of the plurality of elongated primary and secondary pipes 22, 40 to hold them in tangential contact.

Figure 2:
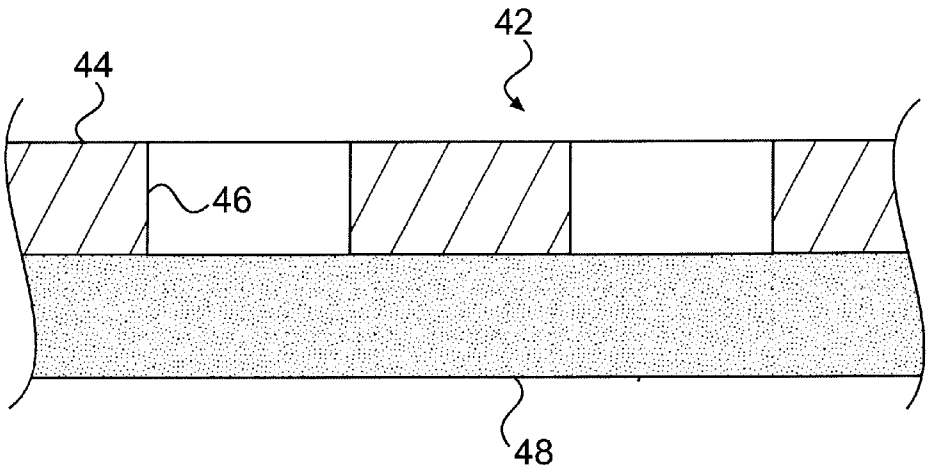
FIG. 2 is a close up view of one embodiment of the material of FIG. 1.

In another embodiment, shown in FIG. 2, the material 42 may include two layers. One of the two layers, or first layer 44, may have a plurality of holes 46 formed in the first layer 44. The plurality of holes 46 may be sized to allow fluid and small particulates to pass through but prevent passage of larger particulates and also may have a sufficient strength to hold the primary and secondary pipes 22, 40 in tangential contact. The first layer 44 may be a standard geogrid or any other suitable wrap material. Geogrids are typically formed of a single layer of material having a plurality of holes formed in the layer of material. Alternatively, the first layer 44 may be a geonet material or other net type of material. Geonets are typically woven from strands of material to form a net capable of allowing passage of fluids but prevents passage of large particulates For example, ADS 2312 available from Advanced Drainage Systems may be used. This type of geonet is a biaxial 3 layer net with a peak tensile strength of 2100 pounds per foot and has a tensile modulus of 30,800 pounds per foot. It is to be understood that other geonets could be used depending on the size of the pipe assembly.

The other of the two layers, or second layer 48, may be formed of a filter material. The filter material allows fluid to pass through but prevents substantially all particulate matter from passing through it. The filter material may be formed from a geotextile material, such as a non-woven needle punched polypropylene fabric, or any other suitable filter material. The filter material may have a minimum weight of about 4 ounces per square yard of fabric, although other weights may be used depending on the size of the pipe assembly.

Figure 3:
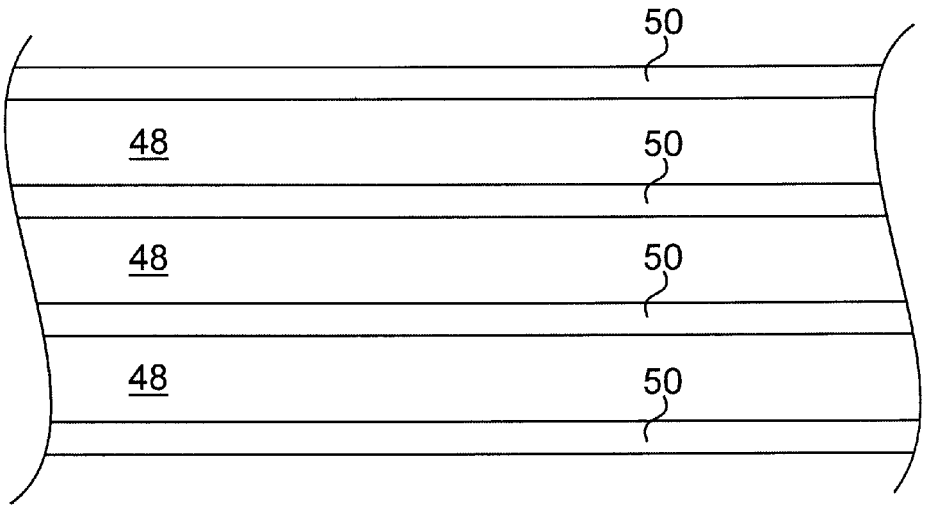
FIG. 3 is a top plan view of another embodiment of the material of FIG. 1.

FIG. 3 shows another embodiment of the material 42, wherein the material 42 is formed as a plurality of straps 50 disposed to hold the plurality of elongated primary and secondary pipes 22, 40 in tangential contact. The material 42 may further include the second layer 48 disposed between the plurality of straps 50 and the plurality of elongated primary and secondary pipes 22, 40. By using straps, as opposed to using a material 42 that substantially encompasses the plurality of primary and secondary pipes 22, 40, the cost of the pipe assembly 20 can be reduced.

In addition to choosing a variety of material 42 to secure the elongated primary and secondary pipes 22, 40 in tangential contact, it is possible to provide a variety of different types of pipes for the pipe assembly 20. For example, in the embodiment shown in FIG. 1, at least some or all of the plurality of elongated primary pipes and secondary pipes 22, 40 may be formed from flexible material. In addition, at least some or all of the plurality of elongated primary pipes and secondary pipes 22, 40 have a smooth inner surface and a smooth outer surface. This particular embodiment of the pipe assembly 20 may be desirable in a water storage system where the surrounding ground has a low permeability. In this situation, the pipe assembly 20 may be used to collect water from a surface and/or transport the surface water to a different location. These different approaches will be described in more detail below.

Figure 4A:
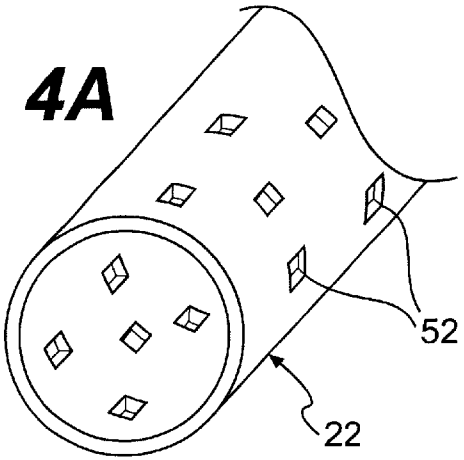
FIGS. 4A and 4B are partial isometric views of a single primary pipe of different construction.
Figure 4B:
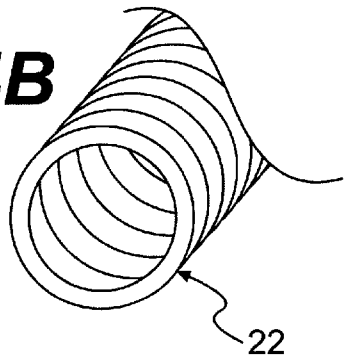

As shown in FIGS. 4A and 4B, the shape of the elongated primary pipes and secondary pipes 22, 40 may be different from those shown in FIG. 1. For example, FIG. 4A shows a primary pipe 22 with perforations 52. The perforations 52 can be used to serve different purposes as described below. The perforations 52 may be any suitable size and can have any desired distribution.

Figure 5A:
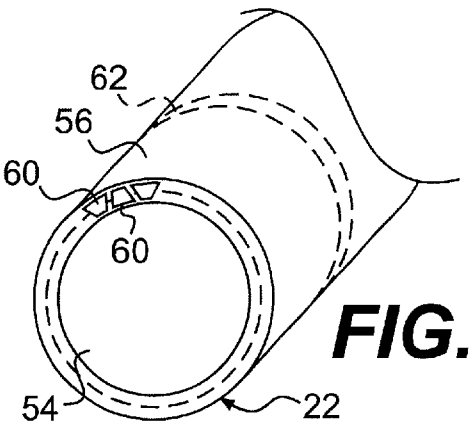
FIGS. 5A and 5B are partial isometric views of a single primary pipe with different wall profiles.
Figure 5B:
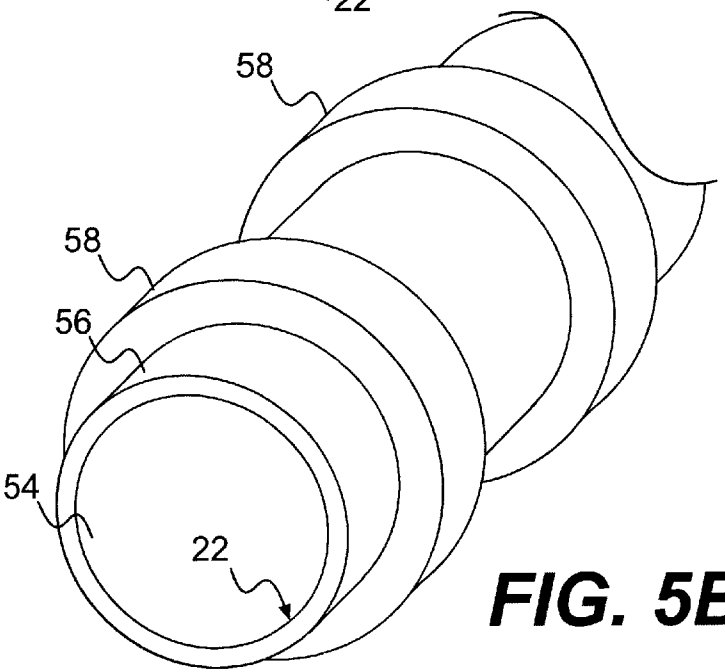

FIG. 4B shows a primary pipe 22 that is corrugated. The corrugated pipes can be used in situations where a more flexible pipe is desired. In addition to using corrugated or perforated pipes, profiled pipes may be used, as seen in FIGS. 5A and 5B.

A profiled wall is formed wherein either the inner surface or the outer surface of the pipe has a smooth surface, while the other of the inner surface or the outer surface has an raised annular shape. For example, FIG. 5B shows a primary pipe 22 having a smooth inner surface 54 and an outer surface 56 having standing ribs 58 disposed axially the length of the pipe 22. It is also understood that a profiled wall may have both a smooth inner and outer surface and the wall of the pipe may have some internal structure arranged annularly. For example, FIG. 5A shows a profiled wall having both a smooth inner surface 54 and a smooth outer surface 56. A plurality of hollow spaces 60 are formed in the wall of the pipe 22 between the inner surface 52 and outer surface 54. These hollow spaces 60 may be disposed annularly in axial-spaced bands 62 along the length of the pipe 22. The hollow spaces 60 are provided to reduce the weight of the pipes.

In FIGS. 4A–5B, the pipes have been shown as primary pipes 22. It is understood that similar pipes could be used for secondary pipes 40 as well. It is also understood that the pipes can be mixed to form many different combinations to be used in a pipe assembly.

Besides varying the size and shape of the primary and secondary pipes 22, 40, both the primary and secondary pipes 22, 40 can be formed out of different materials. For example, at least some of the plurality of elongated primary and secondary pipes 22, 40 may be formed out of plastic or metal. Some suitable plastics may include high-density polyethylene, polyvinyl chloride, polypropylene, or fiberglass, although the present invention is not limited to such plastics. Some suitable metals may include steel, steel alloy, aluminum, or aluminum alloy, although the present invention is not limited to such metals. These materials may be selected based on cost and desired features for the pipe assembly.

Figure 6:
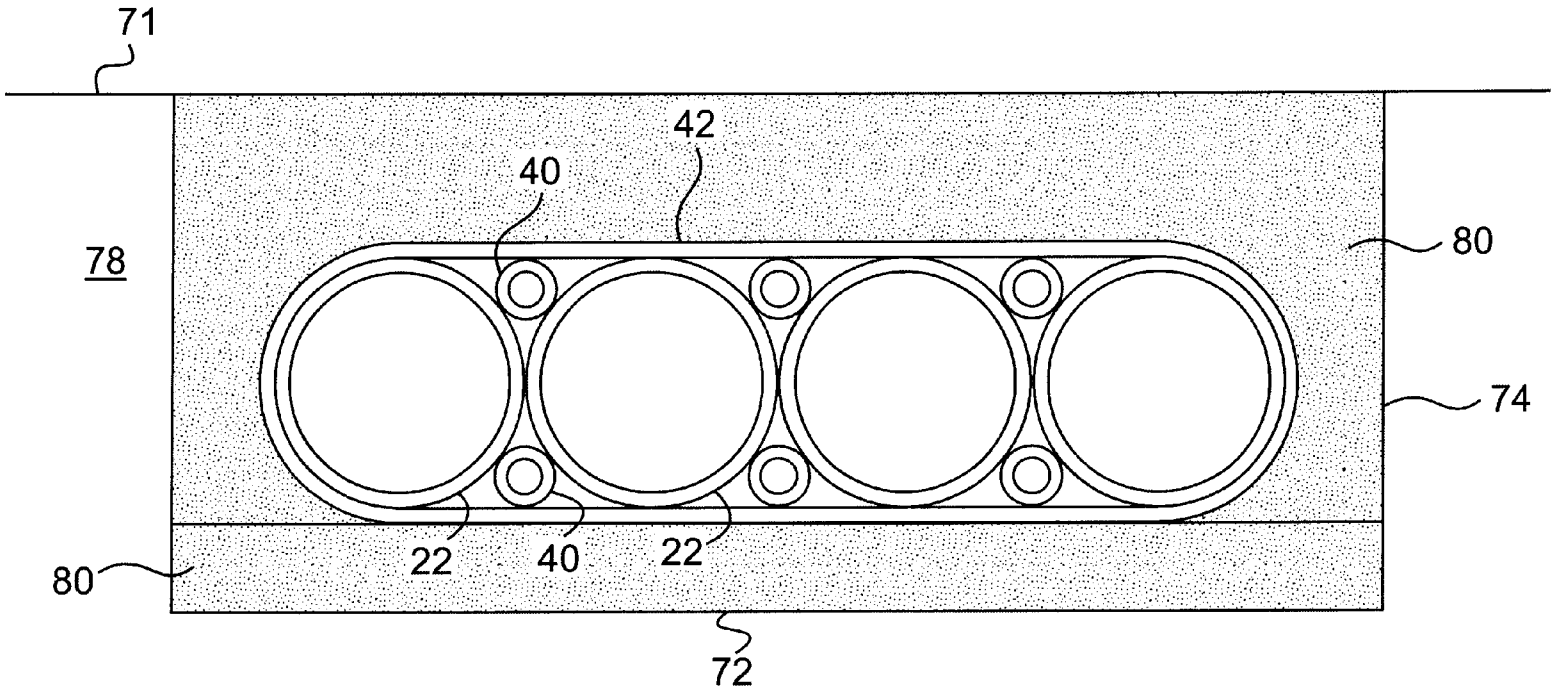
FIG. 6 is a schematic cross-section view of a water storage system.

In accordance with the invention, a water storage system for collecting water runoff comprises a pipe assembly arranged on the bottom of a hole in the earth, and a fill material substantially covering the pipe assembly and substantially filling the hole in the earth. The pipe assembly includes a plurality of elongated primary pipes disposed in tangential contact along their lengths. Each pair of primary pipes defines upper and lower voids between adjacent pipe haunches and upper and lower imaginary planes tangential to the adjacent primary pipes. An elongated secondary pipe is disposed in each void in tangential contact along its length with both adjacent primary pipes. A material encompasses the plurality of elongated primary pipes and elongated secondary pipes. As embodied herein and shown in FIG. 6, a water storage system preferably includes the pipe assembly 20 arranged on the bottom 72 of a hole 74 in the earth. A fill material 80 substantially covers the pipe assembly 20 and substantially fills the hole 74. The fill material 80 may be any suitable material, such as, but not limited to, gravel, sand, and soil. In a preferred embodiment, the fill material 80 is a gravel that can be substantially compacted around the pipe assembly 20.

In accordance with the invention, a method for installing a water storage system comprises assembling a pipe assembly, disposing the pipe assembly on the bottom of a hole in the earth, and disposing a fill material over the pipe assembly and substantially filling the hole.

Figure 7A:
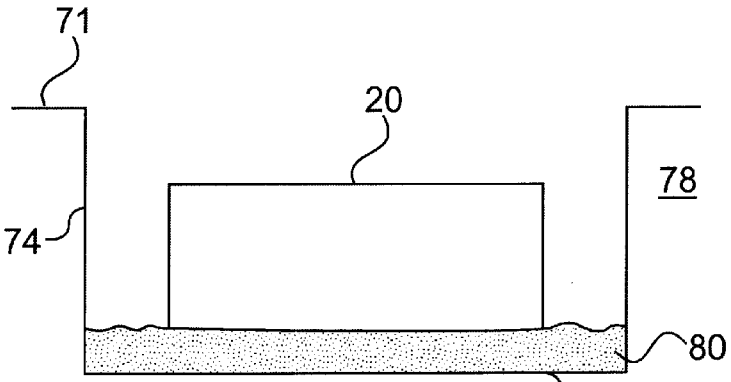
FIGS. 7A and 7B are schematic representations of a method of installing a preformed pipe assembly in a water storage system.
Figure 7B:
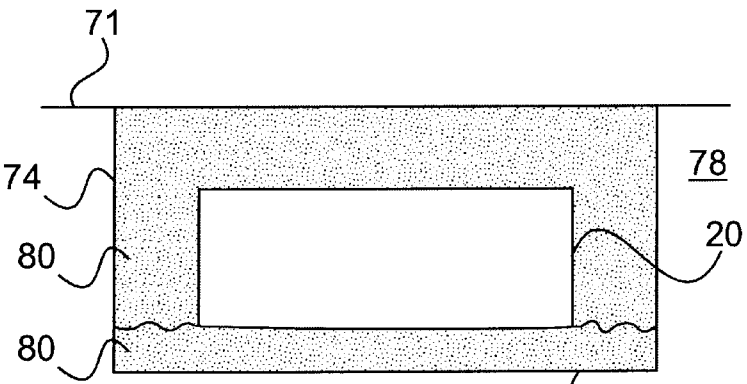

As seen in FIGS. 7A and 7B, the method preferably includes assembling the pipe assembly 20 and disposing it on the bottom 72 of the hole 74 in the earth 78. Next, the method includes disposing a fill material 80 over the pipe assembly 20 and substantially filling the hole 74. The method may also include placing a layer of fill material 80 on the bottom 72 of the hole 74 before the pipe assembly 20 is disposed in the hole. In this method the pipe assembly may be preassembled before delivery to the site, or it may be assembled at the site and placed in the hole 74.

In accordance with another aspect of the invention, as seen in FIGS. 8A–8D, an alternative method of installing a water storage system comprises digging a hole in the earth, such that the hole has a substantially planar bottom surface. Placing a material on the planar surface, wherein the material has opposed ends. Arranging a first plurality of elongated secondary pipes on the material, wherein the elongated secondary pipes are spaced from and substantially parallel to each other. Disposing a plurality of elongated primary pipes on the material in elongated tangential contact, wherein each pair of adjacent primary pipes defines upper and lower voids between adjacent pipe haunches and upper and lower imaginary planes tangential to the adjacent primary pipes. The primary pipes are disposed to locate one of the first plurality of elongated secondary pipes in each lower void in tangential contact with both adjacent elongated primary pipes along their lengths. Next, arranging an elongated secondary pipe in each of the upper voids in elongated tangential contact with the primary pipes defining the void. Finally, connecting the opposed ends of the material to encompass the plurality of elongated primary and secondary pipes with the material to form a pipe assembly.

Figure 8C:
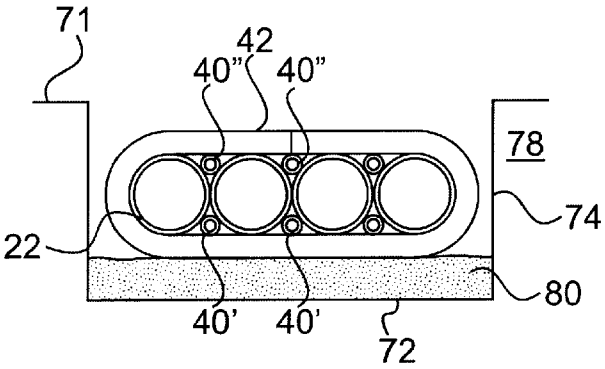
FIGS. 8A–8D are schematic representations of another method of installing a water storage system.
Figure 8D:
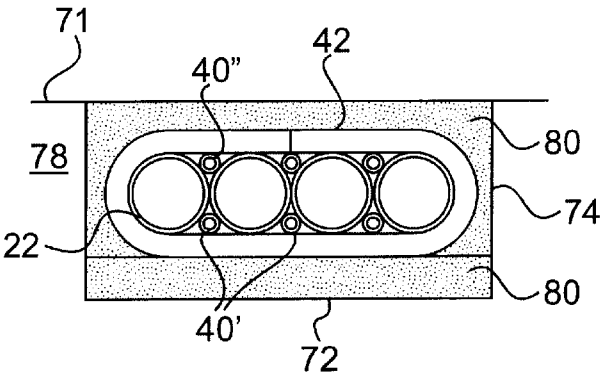
Figure 8A:
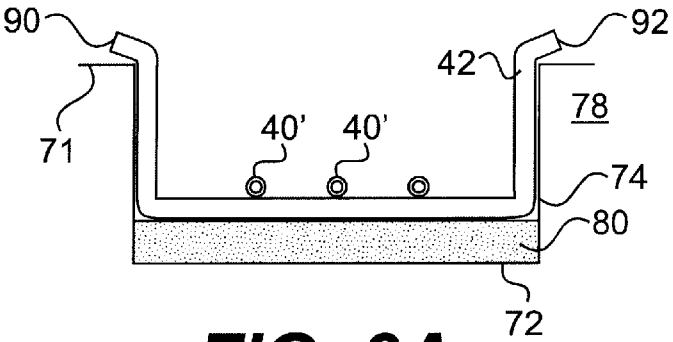

As seen in FIG. 8A, the method includes digging a hole 74 in the earth 78, wherein the hole may have a substantially planar bottom surface 72. Next, the method includes placing a material 42 having opposed ends 90, 92, on the planar surface 72. Next, the method includes arranging a first plurality of elongated secondary pipes 40' on the material, where the elongated secondary pipes 40' are spaced from and substantially parallel to each other.

Figure 8B:
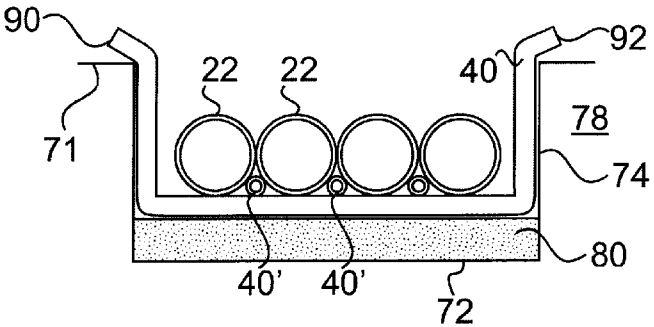

The method further includes disposing a plurality of elongated primary pipes 22 on the material 42 in elongated tangential contact, as seen in FIG. 8B. Each pair of adjacent primary pipes 22 define upper and lower voids 24, 32 between adjacent pipe haunches 26–28, 34–36 and upper and lower imaginary planes 30, 38 tangential to the adjacent primary pipes 22. The primary pipes 22 are disposed to locate one of the first plurality of elongated secondary pipes 40' in each lower void 32, each of the first plurality of elongated secondary pipes 40' are in tangential contact with both adjacent elongated primary pipes 22 along their lengths.

Next, as seen in FIG. 8C, the method includes arranging an elongated secondary pipe 40" in each of the upper voids 24 in elongated tangential contact with the primary pipes 22 defining the void 24. Finally, the method includes connecting the opposed ends 90, 92 of the material 42 to encompass the plurality of elongated primary pipes 22 and elongated secondary pipes 40', 40" with the material 42 to form a pipe assembly. This material 42 may be any of the materials described in relation to FIGS. 1–3.

As seen in FIG. 8D, the method may further include placing a fill material 80 to substantially cover the pipe assembly 20 and substantially filling the hole 74. This step may be performed after any other connections to the input flow path 82 and output flow path 84 (shown in FIGS. 9A–9C) are made. In addition, the method may include placing a portion of the fill material 80 on the planar surface 72 of the hole 74 before placing the material 42 in the hole 74.

In accordance with the invention, a method for collecting water runoff comprises disposing a pipe assembly a predetermined distance below a surface, providing an input flow path from the surface to the pipe assembly, the input flow path allowing fluid flow communication between the surface and the pipe assembly, and collecting at least a portion of the surface water through the input flow path into the pipe assembly. This method may be used with several different water storage systems.

Figure 9B:
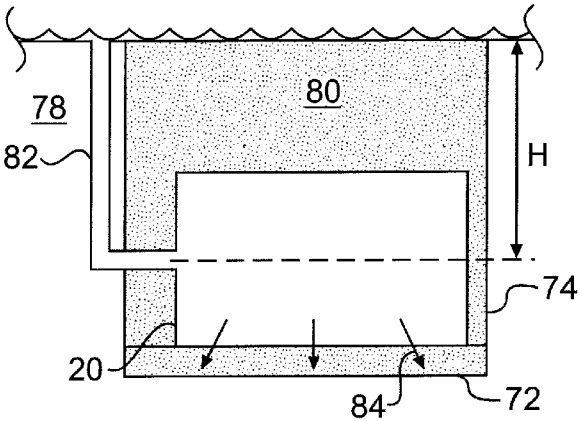
FIGS. 9A–9C are schematic drawings showing the layout of different water storage systems for collecting surface water using a pipe assembly of the invention.
Figure 9A:
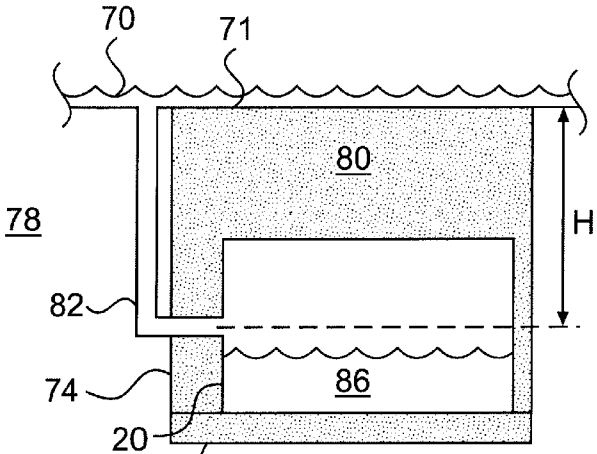

In general, as seen in FIG. 9A, a water storage system may include a pipe assembly 20 arranged a predetermined distance H below the surface 71 on the bottom 72 of a hole 74 in the earth 78. A fill material 80 substantially covers the pipe assembly 20 and substantially fills the hole 74. The pipe assembly 20 can include any number of primary pipes and a number of secondary pipes disposed in the voids.

In a further aspect, as seen in FIG. 9A, the water storage system includes an input flow path 82 connecting the pipe assembly 20 to the surface 71. This will allow fluid flow communication between the surface 71 and the pipe assembly 20. Any suitable manifolds or connectors may be used to join the input flow path 82 to the pipe assembly 20, so long as they do not interfere with the contacts between the primary and secondary pipes 22, 40.

The input flow path 82 can take many forms including a drainage pipe and a water inlet when the surface 71 is the ground or a paved surface. The input flow path 82 can also be a waterspout when the surface is a roof of a building (not shown). The pipe assembly 20 can collect, by draining, at least a portion 86 of the surface water 70 through the input flow path 82 and storing it there until it can be removed.

Such a system shown in FIG. 9A, may be used in the method for collecting water runoff that includes disposing the pipe assembly 20 the predetermined distance H below the surface 71. The method further includes providing the input flow path 82 from the surface 70 to the pipe assembly 20. The input flow path 82 allows fluid flow communication between the surface 70 and the pipe assembly 20. Finally the method includes collecting at least a portion 86 of the surface water 71 through the input flow path 82 into the pipe assembly 20.

Figure 9C:
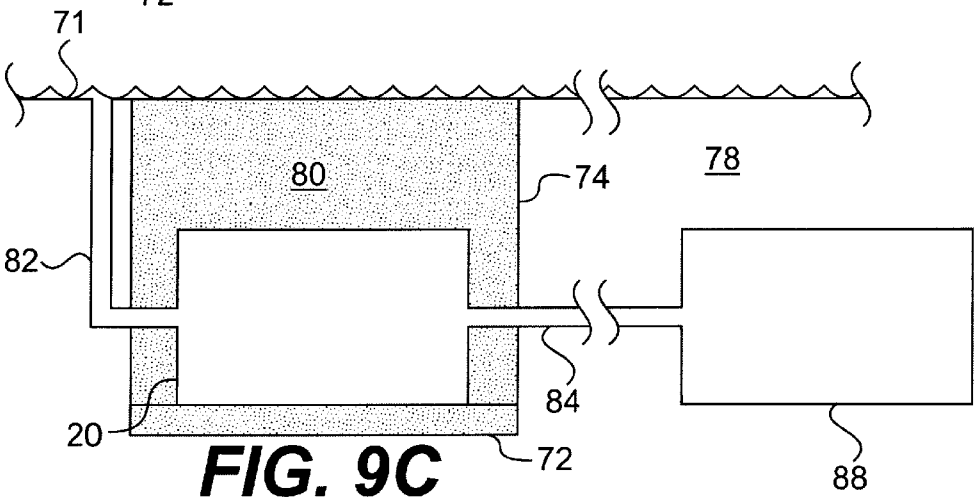

FIGS. 9B and 9C show other alternative embodiments of water storage systems and methods. The alternative embodiments of the water storage systems and methods differ primarily from the water storage system and method shown in FIG. 6A. by disposing the pipe assembly 20 between the input flow paths 82 and the output flow paths 84.

In the water storage system, as seen in FIG. 9B, the output flow path 84 is created by allowing the portion 86 of the surface water 70 to seep through perforations provided in the pipes of the pipe assembly 20. The water then percolates into the surrounding fill material 80 and through the bottom 72 of the hole 74. This water storage system may be best suited for areas where the permeability of the soil is high. In areas where the permeability of the soil is low, water storage system depicted in FIG. 9C may work the best.

FIG. 9C shows the water storage system 68 where the outflow path 84 is provided by a channel connecting the pipe assembly 20 to a water system 88. In this embodiment, the water system 88 is underground and the channel may be any suitable piping that connects the water system 88 to the pipe assembly. Alternatively, the water system may be a natural or manmade pond, a water treatment system, river or other body of water.

In both of the water storage systems, as seen in FIGS. 9B and 9C, the method of collecting surface water 70 from a surface 71 preferably includes disposing pipe assembly 20 on the bottom 72 of the hole 74 in the earth 78 between an input flow path 82 and an output flow path 84, draining at least a portion 86 of the surface water 70 using the input flow path 82, and collecting the portion 86 of the surface water 70 in the pipe assembly 20. In either system, the input flow path may be a drainage pipe.

In addition, the portion 86 of the surface water 70 can be removed from the pipe assembly 20 using the output flow path 84.

As an alternative to the input flow path 82 shown in FIG. 9C, the input flow path 82 may be a path surface water takes when it percolates through the fill material 80. The water can seep into perforated pipes of the pipe assembly 20. In this arrangement, the perforations would be provided on portions of the pipes 22, 40 nearest the surface 71.

Figure 10:
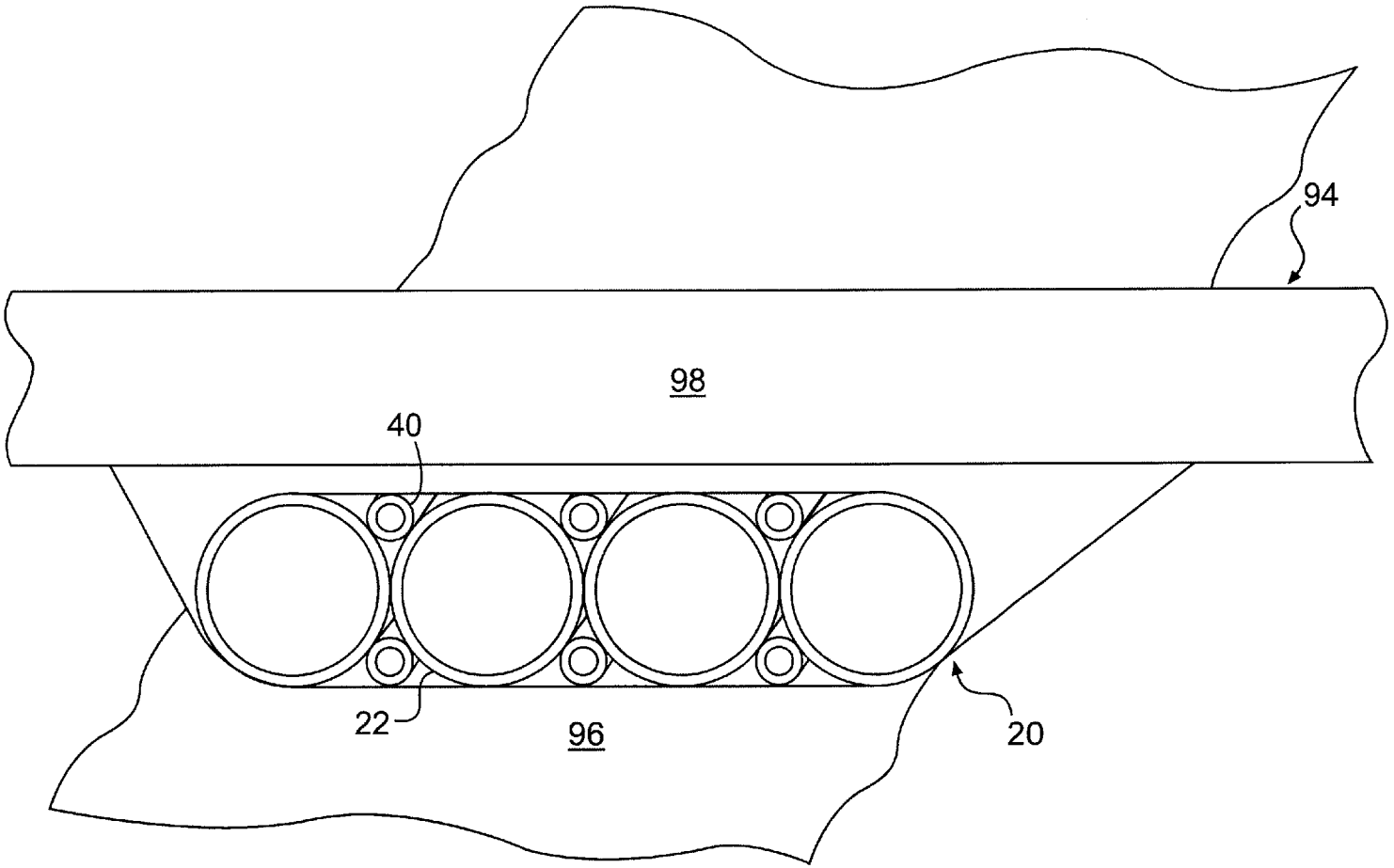
FIG. 10 is a schematic drawing showing a low water crossing using a pipe assembly of the invention.

In a different system, the pipe assembly 20 may be used in a low water crossing 94 of a water flow path 96, such as a stream, as seen in FIG. 10. A low water crossing 94 may include a path 98, such as a roadway, that is designed to handle low volumes of traffic. In this embodiment, the pipe assembly 20 is disposed in the water flow path 96 and paved over with the roadway 98. These low water crossings may be used in parks, state forests, national forests, or anyplace it is necessary to provide a crossing over a water flow path.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A pipe assembly for collecting water runoff comprising:

a plurality of elongated primary pipes disposed in adjacent contact along their lengths, each pair of adjacent elongated primary pipes defining upper and lower elongated voids defined by adjacent pipe haunches and by their respective upper and lower imaginary planes tangential thereto;

an elongated secondary pipe disposed in each void in tangential contact along its length with the two adjacent elongated primary pipes defining the void; and a material transversely encompassing the plurality of elongated primary pipes and elongated secondary pipes.

2. The pipe assembly according to claim 1, wherein at least some of the plurality of elongated primary and secondary pipes are formed from flexible material.

3. The pipe assembly according to claim 1, wherein at least some of the plurality of elongated primary and secondary pipes are plastic.

4. The pipe assembly according to claim 3, wherein the plastic is selected from the group comprising of high density polyethylene, polyvinyl chloride, polypropylene, or fiberglass.

5. The pipe assembly according to claim 1, wherein at least some of the plurality of elongated primary and secondary pipes are metal.

6. The pipe assembly according to claim 5, wherein the metal is selected from the group comprising of steel, steel alloy, aluminum, or aluminum alloy.

7. The pipe assembly according to claim 1, wherein at least some of the plurality of elongated primary and secondary pipes are corrugated.

8. The pipe assembly according to claim 1, wherein at least some of the plurality of elongated primary and secondary pipes are perforated.

9. The pipe assembly according to claim 1, wherein at least some of the plurality of elongated primary and secondary pipes are smooth walled.

10. The pipe assembly according to claim 1, wherein at least some of the plurality of elongated primary and secondary pipes have a profiled wall.

11. The pipe assembly according to claim 10, wherein the profiled wall include standing ribs.

12. The pipe assembly according to claim 10, wherein the profiled wall includes an inner surface, an outer surface, and hollow spaces formed between the inner surface and the outer surface.

13. The pipe assembly according to claim 1, wherein the material has sufficient strength to hold the plurality of elongated primary and secondary pipes in tangential contact, and the material is porous to fluid but prevents passage of particulates.

14. The pipe assembly according to claim 1, wherein the material includes two layers, one of the two layers having a plurality of holes, the other of the two layers being a filter material.

15. The pipe assembly according to claim 14, wherein the filter material is a geotextile.

16. The pipe assembly according to claim 14, wherein said one of the two layers is a geonet.

17. The pipe assembly according to claim 14, wherein said one of the two layers is a geogrid.

18. The pipe assembly according to claim 1, wherein the material comprises a plurality of straps disposed to hold the plurality of elongated primary and secondary pipes in tangential contact.

19. The pipe assembly according to claim 18, wherein the material comprises a layer of filter material disposed between the plurality of straps and the plurality of elongated primary and secondary pipes.

20. The pipe assembly according to claim 1, wherein the material substantially encompasses the length of the plurality of elongated primary and secondary pipes to hold them in tangential contact.

21. A method of collecting surface water comprising:

disposing the pipe assembly of claim 1 a predetermined distance below a surface;

providing an input flow path from the surface to the pipe assembly, the input flow path allowing fluid flow communication between the surface and the pipe assembly; and collecting at least a portion of the surface water the input flow path into the pipe assembly.

22. A method of installing a water storage system comprising:

assembling a pipe assembly according to claim 1;

disposing the pipe assembly on the bottom of a hole in the earth;

disposing a fill material over the pipe assembly and substantially filling the hole.

23. A pipe assembly for collecting water runoff comprising:

a plurality of elongated, corrugated, plastic primary pipes disposed in adjacent contact along their lengths, each pair of adjacent elongated primary pipes defining upper and lower elongated voids defined by adjacent pipe haunches and by their respective upper and lower imaginary planes tangential thereto;

an elongated, corrugated, plastic secondary pipe disposed in each void in tangential contact along its length with the two adjacent elongated primary pipes defining the void; and a material transversely encompassing the plurality of elongated primary pipes and elongated secondary pipes.

24. A pipe assembly for collecting water runoff comprising:

a plurality of elongated primary pipes disposed in adjacent contact along their lengths, each pair of adjacent elongated primary pipes defining upper and lower elongated voids defined by adjacent pipe haunches and by their respective upper and lower imaginary planes tangential thereto;

an elongated secondary pipe disposed in each void in tangential contact along its length with the two adjacent elongated primary pipes defining the void, some of the primary and secondary pipes being perforated plastic pipes; and a material transversely encompassing the plurality of elongated primary pipes and elongated secondary pipes to hold them in tangential contact.

25. A pipe assembly for collecting water runoff comprising:

a plurality of elongated primary pipes disposed in adjacent contact along their lengths, each pair of adjacent elongated primary pipes defining upper and lower elongated voids defined by adjacent pipe haunches and by their respective upper and lower imaginary planes tangential thereto;

an elongated secondary pipe disposed in each void in tangential contact along its length with the two adjacent elongated primary pipes defining the void; and a material transversely encompassing the plurality of elongated primary pipes and elongated secondary pipes, the material having two layers, one of the two layers having sufficient strength to hold the plurality of elongated primary and secondary pipes in tangential contact, the other of the two layers being porous to fluid but preventing passage of particulates.

26. A pipe assembly according to claim 25, wherein the other of the two layers is a geotextile material.

27. A water storage system for collecting surface water comprising:

a pipe assembly arranged on the bottom of a hole in the earth, the pipe assembly comprising a plurality of elongated primary pipes disposed in tangential contact along their lengths, each pair of primary pipes defining upper and lower voids defined by adjacent pipe haunches and by their respective upper and lower imaginary planes tangential to the adjacent primary pipes, an elongated secondary pipe disposed in each void in tangential contact along its length with both adjacent primary pipes, and a material encompassing the plurality of elongated primary pipes and elongated secondary pipes;

a fill material substantially covering the pipe assembly and substantially filling the hole in the earth.

28. The water storage system according to claim 27, wherein at least some of the plurality of elongated primary and secondary pipes are plastic.

29. The water storage system according to claim 28, wherein the plastic is selected from the group comprising of high density polyethylene, polyvinyl chloride, polypropylene, or fiberglass.

30. The water storage system according to claim 27, wherein at least some of the plurality of elongated primary and secondary pipes are metal.

31. The water storage system according to claim 27, wherein at least some of the plurality of elongated primary and secondary pipes are corrugated.

32. The water storage system according to claim 27, wherein at least some of the plurality of elongated primary and secondary pipes are perforated.

33. The water storage system according to claim 27, wherein the material has two layers, one of the two layers has sufficient strength to hold the plurality of elongated primary and secondary pipes in tangential contact, and the other of the two layers is porous to fluid but prevents passage of particulates.

34. A pipe assembly according to claim 33, wherein the other of the two layers is a geotextile material.

35. A method of installing a water storage system comprising digging a hole in the earth, the hole having a substantially planar bottom surface;

placing a material on the planar surface, the material having opposed ends;

arranging a first plurality of elongated secondary pipes on the material, the elongated secondary pipes being spaced from and substantially parallel to each other;

disposing a plurality of elongated primary pipes on the material in elongated tangential contact, each pair of adjacent primary pipes defining upper and lower voids defined by adjacent pipe haunches and by their respective upper and lower imaginary planes tangential to the adjacent primary pipes, the primary pipes being disposed to locate one of the first plurality of elongated secondary pipes in each lower void in tangential contact with both adjacent elongated primary pipes along their lengths;

arranging an elongated secondary pipe in each of the upper voids in elongated tangential contact with the primary pipes defining the void; and connecting the opposed ends of the material to encompass the plurality of elongated primary pipes and elongated secondary pipes with the material to form a pipe assembly.

36. The method according to claim 35, further comprising placing a fill material to substantially cover the pipe assembly and substantially filling the hole.

37. The method according to claim 35, wherein at least some of the plurality of elongated primary and secondary pipes are plastic.

38. The method according to claim 35, wherein the plastic is selected from the group comprising of high density polyethylene, polyvinyl chloride, polypropylene, or fiberglass.

39. The method according to claim 35, wherein at least some of the plurality of elongated primary and secondary pipes are metal.

40. The method according to claim 35, wherein at least some of the plurality of elongated primary and secondary pipes are corrugated.

41. The method according to claim 35, wherein at least some of the plurality of elongated primary and secondary pipes are perforated.

42. The method according to claim 35, wherein the material has two layers, one of the two layers has sufficient strength to hold the plurality of elongated primary and secondary pipes in tangential contact, the other of the two layers is porous to fluid but prevents passage of particulates.

43. A method of collecting surface water from a surface comprising:

providing a pipe assembly arranged on the bottom of a hole in the earth, the pipe assembly comprising a plurality of elongated primary pipes disposed in tangential contact along their lengths, each pair of primary pipes defining upper and lower voids defined by adjacent pipe haunches and by their respective upper and lower imaginary planes tangential to the adjacent primary pipes, an elongated secondary pipe disposed in each void in tangential contact along its length with both adjacent primary pipes, and a material encompassing the plurality of elongated primary pipes and elongated secondary pipes;

disposing the pipe assembly between an input flow path and an output flow path;

draining at least a portion of the surface water using the input flow path;

collecting the portion of the surface water in the pipe assembly; and draining at least some of the portion of the surface water collected in the pipe assembly through the output flow path.

44. The method according to claim 43, wherein the input flow path is a drainage pipe.

45. The method according to claim 43, wherein the output flow path comprises a channel connecting the pipe assembly to another water system.

46. The method according to claim 43, wherein the output flow path comprises percolation through the bottom of the hole.

47. A system for use in a water flow path, the system comprising:

a pipe assembly arranged in a water flow path, the pipe assembly comprising a plurality of elongated primary pipes disposed in adjacent contact along their lengths, each pair of adjacent elongated primary pipes defining upper and lower elongated voids defined by adjacent pipe haunches and by their respective upper and lower imaginary planes, an elongated secondary pipe disposed in each void in tangential contact along its length with the two adjacent elongated primary pipes defining the void, and a material transversely encompassing the plurality of elongated primary pipes and elongated secondary pipes; and a path formed over the pipe assembly.

48. A pipe assembly according to claim 47, wherein the path is a roadway.

* * * * *